US006904645B1

(12) United States Patent
Lautenschläger

(10) Patent No.: US 6,904,645 B1
(45) Date of Patent: Jun. 14, 2005

(54) FURNITURE HINGE

(75) Inventor: Gerhard Wilhelm Lautenschläger, Brensbach (DE)

(73) Assignee: Mepla-Werke Lautenschlager GmbH & Co. KG, Reinheim (DE)

( * ) Notice: Subject to any disclaimer, the term of this patent is extended or adjusted under 35 U.S.C. 154(b) by 0 days.

(21) Appl. No.: 10/130,737

(22) PCT Filed: Sep. 26, 2000

(86) PCT No.: PCT/EP00/09350

§ 371 (c)(1),
(2), (4) Date: May 16, 2002

(87) PCT Pub. No.: WO01/40608

PCT Pub. Date: Jun. 7, 2001

(30) Foreign Application Priority Data

Nov. 29, 1999 (DE) ..... 299 20 945 U

(51) Int. Cl.[7] ..... E05D 11/10
(52) U.S. Cl. ..... 16/382; 16/383; 16/235
(58) Field of Search ..... 16/235, 238, 242, 16/245, 246, 236, 383, 384, 382

(56) References Cited

U.S. PATENT DOCUMENTS

| | | | | | |
|---|---|---|---|---|---|
| 4,142,271 | A | * | 3/1979 | Busse | 16/238 |
| 4,493,129 | A | * | 1/1985 | Grass | 16/238 |
| 4,642,846 | A | * | 2/1987 | Lautenschlager | 16/382 |
| 4,691,408 | A | * | 9/1987 | Rock et al. | 16/241 |
| 4,862,556 | A | * | 9/1989 | Grass | 16/382 |
| 5,611,113 | A | * | 3/1997 | Rock et al. | 16/246 |
| 5,964,011 | A | * | 10/1999 | Ruston et al. | 16/239 |
| 6,145,164 | A | * | 11/2000 | Ferrari et al. | 16/242 |
| 6,289,556 | B1 | * | 9/2001 | Salice | 16/335 |
| 6,336,253 | B1 | * | 1/2002 | Salice | 16/382 |

FOREIGN PATENT DOCUMENTS

| | | |
|---|---|---|
| AT | 001 787 | 11/1997 |
| DE | 196 50 062 | 6/1998 |

* cited by examiner

*Primary Examiner*—Chuck Y. Mah
*Assistant Examiner*—Michael J. Kyle
(74) *Attorney, Agent, or Firm*—Norris McLaughlin & Marcus PA

(57) ABSTRACT

Furniture hinge (10) for pivotally mounting a door leaf (12) to a cupboard body whose door-side front is narrowed by a frame that projects inwardly at a right angle to the side walls. The hinge has a hinge arm (24) made of sheet metal and provided with a mounting plate (28) on the side facing the cupboard body. The mounting plate (28) can be releaseably secured in superposition with a fastening plate (34) disposed on the free end face (18) of a frame element (16) of the frame that faces away from the side wall. At least one slot-like elongated through opening (30; 36) is provided in the mounting plate (28) and in the fastening plate (34), through which opening the shank of a fastening screw (32) can be screwed into the frame element.

The fastening screw can be screwed into a fixing tenon (44), which is fixed in a bore hole (46) disposed in the frame element (16) and from which there protrudes at least one guide projection, which engages in the elongated through opening of the fastening plate and is supported by the side edges of the through opening (36). A lug-like projection of an adjusting element (62) provided with a cam (66) is rotatably supported in a bearing bore disposed in the front end region of the fixing tenon (44), with the adjusting element (62) supported on the longitudinal sides of the through opening (30). The adjusting element (62) includes an actuating section located above the cam. The head of the fastening screw (32) can be screwed in clamping engagement on the top side of the actuating section.

12 Claims, 3 Drawing Sheets

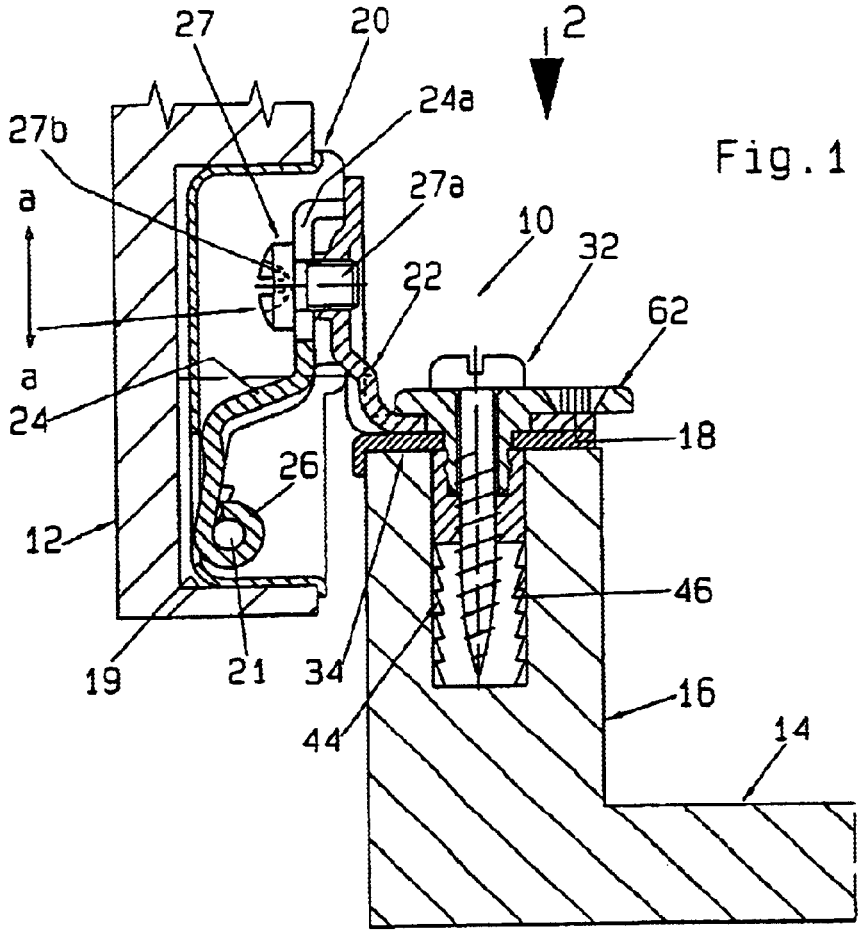
Fig.1
Fig.2
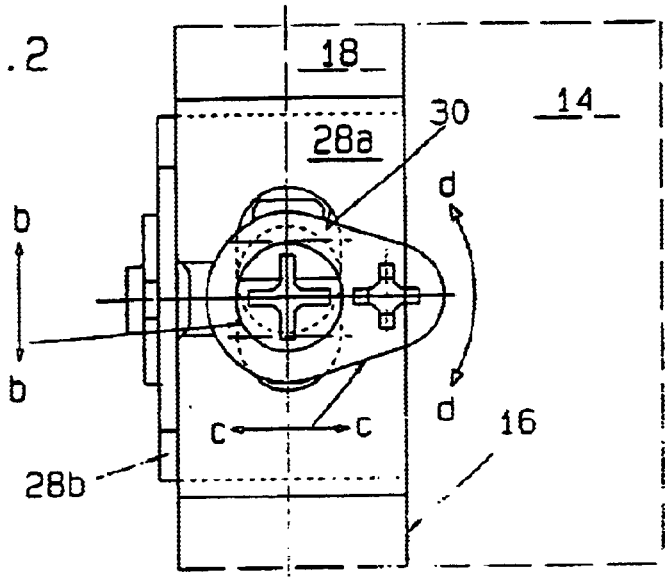

Fig.4
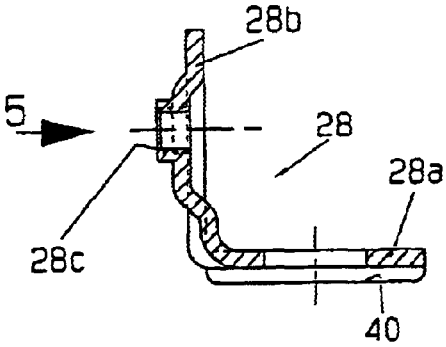
Fig.5
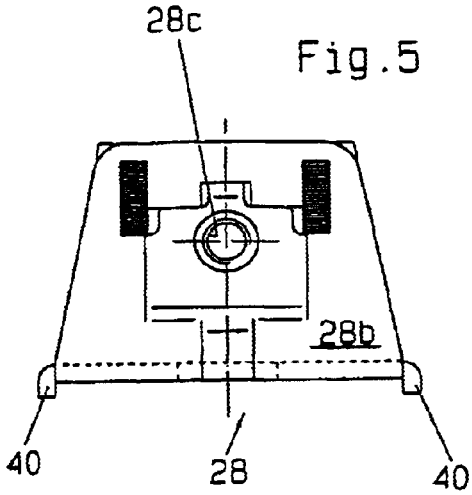
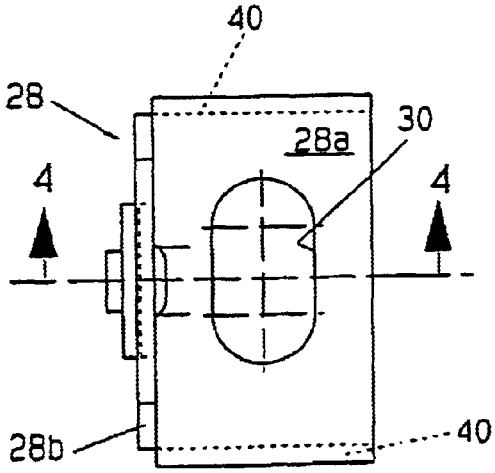
Fig.3
Fig.7
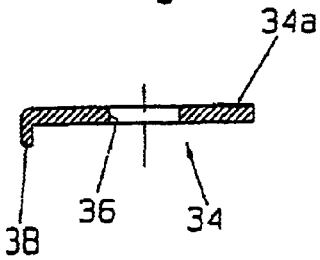
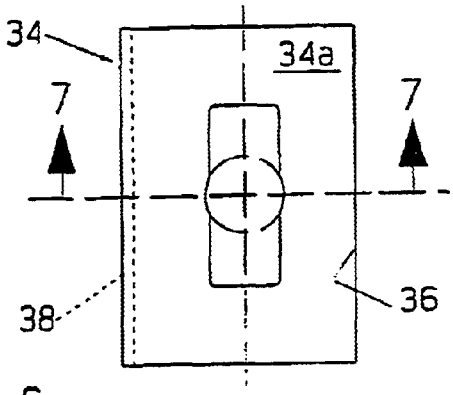
Fig.6

Fig.9
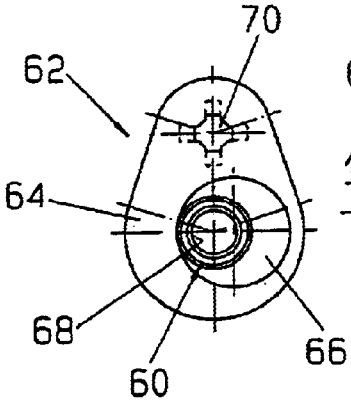
Fig.8
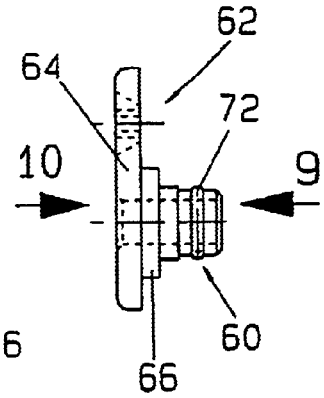
Fig.10
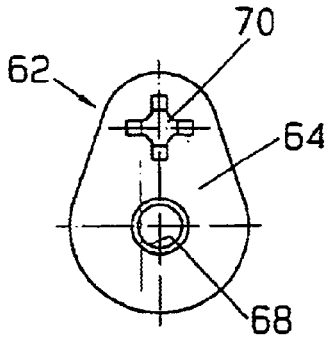
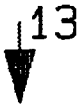
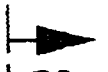
Fig.12
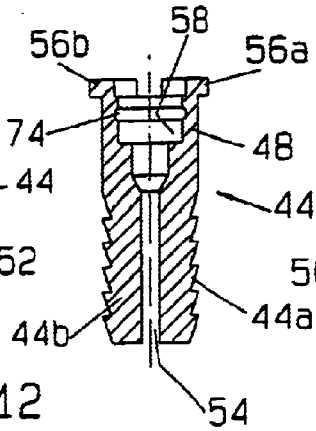
Fig.14
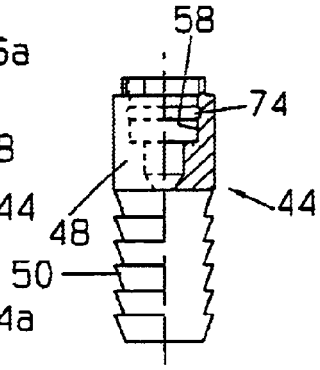
Fig.11
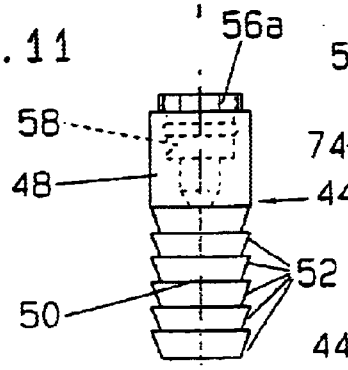
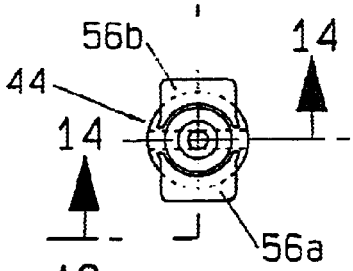
Fig.13

FURNITURE HINGE

BACKGROUND OF THE INVENTION

The invention relates to a furniture hinge for pivotally mounting a door leaf to a cupboard body, whose door-side front is narrowed by a frame that projects inwardly at a right angle to the side walls and is formed by strip-like frame elements. In a closed position, the frame overlaps at least partially with the inside of the door leaf. The furniture hinge further includes a hinge arm made of sheet metal and having on the side of the cupboard body a mounting plate which can be releaseably secured in superposition with a fastening plate disposed on the free end face facing away from the side wall of the frame element of the frame. At least one slot-like elongated through opening extending in the longitudinal direction of the front face of the frame element is provided in the mounting plate and in the fastening plate, through which the shank of a fastening screw may be screwed into the frame element. When the fastening screw is unscrewed, the fastening plate is held so as to be moveable in the longitudinal direction of the front face of the frame element, and the mounting plate is held so as to be moveable perpendicular thereto in the transverse direction of the front face of the fastening plate.

Hinges intended for cupboards with an inwardly projecting frame are typically mounted on the body side with a mounting plate that can be screwed onto the free front face facing away from the side wall of the inwardly projecting frame element. The width of the mounting plate can be approximately identical to the width of the front face of the frame element and form a part of a fastening plate, on which the actual hinge support arm that forms the body-side plate of the hinge can be adjustably attached. Alternatively, the mounting plate can also be an integral part of the hinge arm. To allow height adjustment of the door leaf hinged to the cupboard body after installation, the openings provided in the mounting plate for the fastening screw are typically formed as slots, so that—when the fastening screws are unscrewed—the height of the door leaf can be adjusted within the length range of the slots. The mounting plate is then fixed at the new set height of the door leaf by tightening the fastening screw. The position of the door leaf relative to the front side of the frame element of the cupboard body in the horizontal direction, i.e., the gap spacing between the inside of the door leaf and the front side of the frame element, can then typically no longer be changed, because such adjustment is intentionally prevented by folded-back tabs provided on the front end of the edge of the mounting plate that is connected to the supporting arm, wherein the tabs contact the front side or backside of the respective frame element.

In an improved furniture hinge as compared to older hinges of the aforedescribed type (DE 196 50 062 A1), the gap spacing can be further adjusted by securing the mounting plate that supports the hinge support arm on a separate height-adjustable fastening plate, which is mounted on the frame element in a conventional manner, with a slot for displacement in the transverse direction. The exclusive adjustability in the longitudinal direction of the end face of the frame element is again achieved by guiding the fastening plate on the front and rear side of the frame element and by a slot penetrated by the shank of the fastening screw and by having the support arm displaceable relative to the fastening plate by guides provided in the mounting plate in the displacement direction of the fastening plate. An opening for the shank of the fastening screw is also provided in the mounting plate, which is sized, on one hand, so as to allow the height adjustment and, on the other hand, has a large enough width in the transverse direction so as to enable the desired change in the gap spacing between the inside of the door leaf and the front side of the frame. To lock the adjusted position of the hinge, the head of a tightened fastening screw urges the fastening and mounting plate into contact with one another and into contact with the end face of the frame element. If the setting needs to be changed, then the fastening screw has to be unscrewed, which again allows adjustment in the two coordinate directions. For example, when only the gap spacing of a mounted hinge needs to be adjusted, then it may not be possible to maintain the—actually correct—height setting due to the weight of the door leaf.

SUMMARY OF THE INVENTION

It is therefore an object of the invention to provide a furniture hinge of the aforedescribed type, which allows the required adjustments in height and a change of the gap spacing perpendicular thereto, whereby the hinge can be adjusted in one coordinate direction without the risk of an unintentional adjustment in the second coordinate direction. As an improvement of such a hinge, it should also be possible to adjust the clearance of the door leaf on the front side of the frame element, i.e., to adjust a third coordinate direction perpendicular to the two aforementioned coordinate directions.

Based on a furniture hinge of the aforedescribed type, the object is solved by the invention in that the fastening screw can be screwed into a fixing tenon, which is fixed in a bore hole disposed in the frame element and from which there protrudes at least one guide projection, which engages in the elongated through opening of the fastening plate and is supported by the side edges of the through opening, that a lug-like projection of an adjusting element provided with a cam is rotatably supported in a bearing bore disposed in the front end region of the fixing tenon, that the peripheral surface of the cam is supported on the longitudinal sides of the through opening of the fastening plate, with the cam having a diameter that is substantially identical to the width of the through opening of the mounting plate and being eccentrically offset relative to the lug-like projection, that the adjusting element includes an actuating section located above the cam and laterally overlapping with the mounting plate near the through opening, and that the head of the fastening screw can be screwed in so as to be in clamping engagement with the top side of the actuating section.

With the hinge of the invention, the shank of the fastening screw is no longer screwed directly into the frame element, but into a fixing tenon inserted into a bore of the frame element, which in turn has one or more guide projections that engage with the slot-like through openings of the fastening plate. In this way, the fastening plate is displaceable only into height direction. An additional cam which is rotatably supported in a bearing bore of the fixing tenon by a lug-like projection, is provided for adjusting the gap spacing. The cam engages with the edges of an elongated through opening disposed in the mounting plate that is significantly wider than the through opening in the fastening plate and—depending on its rotation position—fixes the position of the mounting plate relative to the fastening plate to adjust the gap spacing. Separate guides disposed on the mounting plate prevent an adjustment of the height of the mounting plate relative to the fastening plate.

Like a conventional furniture hinge, the fastening plate can have on at least one of its longitudinal edges a tab-like shoulder that is bent at a right angle, which in the defined mounting position on the end face of a frame element contacts the corresponding front and/or rear flat side of the frame element. In this way, the fastening plate cannot rotate on the front face of the frame element, which also prevents rotation of the fixing tenon fixed in the bore of the frame element.

Advantageously, the mounting plate is guided relative to the fastening plate in the desired adjustment direction by providing the mounting plate with tab-like shoulders that extend from its two edges oriented perpendicular to the longitudinal direction of the end face of the frame element and are bent in a direction towards the frame element, wherein the tab-like shoulders contact the corresponding edges of the fastening plate.

The actuating section of the adjusting element includes a lever-like extension through which the adjustment forces required for adjusting the gap spacing are introduced into the cam. The extension can include suitable means for engaging a tool, for example a screwdriver and the like.

To guarantee that the adjusting mechanism continues to function over extended periods of time and after multiple adjustments, the fixing tenon can be divided at least in its end region inside the bore by a transversely extending slit into two tenon halves which can be spread apart by screwing in the shank of the fastening screw.

Advantageously, the guide projection or guide projections can be formed so that the fixing tenon is guided in the through opening for displacement in the longitudinal direction, but formfittingly secured against rotation about its longitudinal center axis.

The guide projection or guide projections can be in a defined engagement position with the elongated through opening, with the slit extending between the two tenon halves of the fixing tenon located in a plane extending perpendicular to the longitudinal extent of the through opening and the flat sides of the fastening plate. When the fastening screws are tightened, the tenon halves are spread apart in the longitudinal direction of the frame element, thereby eliminating spreading forces that could attempt to split the frame element apart between the front and rear side.

The shank of the fastening screw can be screwed into the fixing tenon through a through bore disposed in the adjusting element, wherein the longitudinal center axis of the through bore coincides with the longitudinal center axis of the lug-like projection. The diameter of the through bore in the adjusting element is at least slightly greater than the maximum diameter of the shank of the fastening screw, which allows the adjusting element to rotate without introducing rotational forces into the fastening screw.

The width of the elongated through opening provided in the mounting plate is greater than the width of the elongated through opening provided in the fastening plate, so that the difference in width can be selected depending on the desired adjustments in the gap spacing.

A measurement of the depth of the bearing bore in the fixing tenon as measured in the direction of the longitudinal center axis is slightly greater than a measurement of the section of the lug-like projection, also measured along the longitudinal center axis, that engages in the bearing bore and extends from the flat underside of the cam which is supported on the top side of the fastening plate. With this arrangement, the projection is able to rotate by preventing the end face form pressing against the bottom of the bearing bore even when the fastening screw is tightened.

According to another embodiment of the invention, the lug-like projection can be prevented from unintentionally coming out of the bearing bore when the fastening screw is not inserted, by providing the section of the lug-like projection that engages in the bearing bore with a circumferential annular projection that interlocks with a complementary annular groove disposed in the wall of the bearing bore.

The thickness of the cam measured in the direction of the longitudinal center axis of the fixing tenon should be substantially identical to the thickness of the mounting plate.

According to a modified embodiment, the hinge can be adjusted, as mentioned above, in a third coordinate direction, namely perpendicular to the displacement in height and the gap spacing, for the purpose of changing the clearance of the door leaf on the front side of the frame. For this purpose, the hinge arm is fabricated as an element that is separately from the mounting plate, wherein its end facing the mounting plate is releaseably secured on a tab-like shoulder of the mounting plate which is bent essentially perpendicular into a position that is parallel to the closed inside of the door, so as to be moveable in its released position in a horizontal plane and fixable in selectable displacement positions.

BRIEF DESCRIPTION OF THE DRAWINGS

The invention will be described hereinafter in detail with reference to an embodiment to be read in conjunction with the drawing, wherein FIG. 1 is a longitudinal center cross-section through a furniture hinge according to the invention in the closed position, wherein section of the hinge for attachment to the door is formed as a insertion cup and mounted in a recess of a door leaf, and the section for attachment to the body is illustrated in the mounting position on a frame element of the cupboard body;

FIG. 2 is a view of only the section of the furniture hinge of the invention for attachment to the body as seen in the direction of the arrow 2 in FIG. 1;

FIG. 3 is a view of the mounting plate of the section for attachment to the body according to FIG. 2, as seen in the viewing direction of FIG. 2;

FIG. 4 is a cross-sectional view of the mounting plate, as seen in the direction of the arrows 4—4 in FIG. 3;

FIG. 5 is a view of the mounting plate, as seen is a direction of the arrow 5 in FIG. 4;

FIG. 6 is a top view—as seen in the viewing direction of FIG. 3—of the fastening plate of the section for attachment to the body according to FIG. 2;

FIG. 7 is a cross-sectional view through the fastening plate, as seen is a direction of the arrows 7—7 in FIG. 6;

FIG. 8 is a side view of an eccentric adjusting element for adjusting the mounting plate on the fastening plate;

FIG. 9 is a view of the adjusting element, as seen in the direction of the arrow 9 in FIG. 8;

FIG. 10 is a view of the adjusting element, as seen in the direction of the arrow 10 in FIG. 8;

FIG. 11 is a side view of the fixing tenon, which can be used to fasten the section intended for attachment to the body of FIG. 2 on a frame element;

FIG. 12 is a cross-sectional view of the fixing tenon, as seen in the direction of the arrows 12—12 in FIG. 11;

FIG. 13 is a view of the fixing tenon, as seen is a direction of the arrows 13 in FIG. 11; and FIG. 14 shows the fixing tenon in a partial cross-section indicated in FIG. 13 by the arrows 14—14.

DETAILED DESCRIPTION OF THE PREFERRED EMBODIMENTS

The furniture hinge illustrated in FIG. 1 and having the reference numeral 10 is designed to couple a door leaf 12 to a cupboard body whose front, which is to be closed by the door leaf 12, is narrowed by a inwardly projecting frame formed of strip-like frame elements. FIG. 1 shows a section of a frame element 16 projecting inwardly from the cupboard side wall 14, with the hinge 10 to be secured to the front face 18 of the body facing away from the walls. The exemplary hinge 10, shown here as a single-hinged hinge, has a element 20 for attachment to the door in form of an insertion cup that can be mounted in a recess 19 disposed on the backside of the door leaf 12 and a pivotable element 22 for attachment to the body that can be rotated about a support pin 21 disposed inside the insertion cup.

The element 22 for attachment to the body which in the present example is formed of three pieces, has a hinge arm 24 with an end portion that is disposed in the insertion cup 20 and includes a bearing loop 26 surrounding with the above-mentioned bearing pin 21. On the other end facing the body, the hinge arm is adjustably supported on a mounting plate 28 (FIGS. 3 to 5) which has a plate-like fastening section 28*a* and a tab-like shoulder 28*b* extending essentially perpendicular thereto. A slot-like elongated through opening 30 is provided in the fastening section 28*a*. A threaded bore 28*c* is provided in a sleeve-like embossed center region disposed in the tab-like shoulder 28*b*, into which the threaded shank 27*a* of a fastening screw 27 can be screwed. The fastening screw 27 is guided through a longitudinal slot 24*a* (FIG. 1) in the end region of the hinge arm 24. When the fastening screw 27 is tightened, the head 27*b* of the fastening screw 27 urges the hinge arm 24 into firm contact with the tab-like shoulder 28*b*. Conversely, when the fastening screw 27 is unscrewed, the hinge arm and the insertion cup together with the door leaf 12 can be displaced in a direction indicated in FIG. 1 by the arrows a—a.

The plate-like fastening section 28*a* of the mounting plate 28 is arranged so as to contact a fastening plate 34 (FIGS. 6 and 7) which, like the mounting plate 28 and the hinge arm 24, are made of sheet metal by a stamping process. The fastening plate 34 has a flat plate-shaped section 34*a* which in the intended mounting position is disposed beneath the fastening section 28*a* of the mounting plate 28. A fastening screw 32 extends through the elongated through opening 30 in the mounting plate 28 and through an elongated through opening 38 in the fastening plate 34, holding them together on the end face 18 of the frame element 16. A strip-like narrow section 38 of the front longitudinal edge of the fastening plate 34 facing the door leaf is bent, contacting the front side of the frame element 16 in the intended mounting position, thereby preventing the fastening plate 34 from rotating on the end face 18 of the frame element 16, but allowing displacement in the longitudinal direction of the end face, i.e., in the direction of the arrows b—b of FIG. 2—when the fastening screw 32 is unscrewed.

Each of the two edges of the mounting plate 28 that extend transversely to the longitudinal direction of the end faces, has a corresponding narrow strip-like section 40 that is a bent towards the end face 18 and grips around the transversely extending edges of the fastening plate 34. The width of these strip-like sections 40 as measured perpendicular to the end face 18 is slightly smaller than the thickness of the material of the fastening plate 34, so that their free edges cannot make contact with the end face 18 even when the fastening screw 32 is tightened. The strip-like sections 40 prevent the mounting plate 28 from rotating relative to the fastening plate 34, but allow displacement in the direction of the arrows c—c (FIG. 2).

As seen in FIG. 1, the fastening screw 32 is not directly screwed into the frame element 16, but instead is screwed into a fixing tenon 44 (depicted separately in FIGS. 11 to 14) which can be anchored in the frame element 16 in a blind hole 46 (FIG. 1) which is open towards the end face 18. The fixing tenon 44 has a cylindrically shaped upper section 48 facing the fastening plate. The adjacent section 50 of the fixing tenon 44 is located inside the bore and has a plurality of successive parallel circumferential anchoring projections 52 with a saw-tooth-shaped cross-section. The fixing tenon 44 is further divided by a transverse slit 54 into two tenon halves 44*a*, 44*b* which are urged apart and deformed elastically when the fastening screw 32 is screwed in, so that the saw-tooth-shaped anchoring projections 52 pierce the peripheral wall of the blind hole 46 and anchor the fixing tenon 44 formfittingly in the blind hole 46. Two narrow guide projections 56*a*, 56*b* project outwardly from the end face of the fixing tenon 44 facing the fastening plate. The width of the guide projections 56*a*, 56*b* is approximately identical to the width of the elongated through opening 36 of the fastening plate 34, so that the guide projections also secure the fixing tenon against rotation in the through opening 36. The fastening plate 34 can still be displaced relative to the fixing tenon over the length of the through opening 36. The height of the guide projections is essentially identical to the thickness of the material of the fastening plate 34.

A bearing bore 58 which rotatably supports a lug-like projection 60 of an adjusting element 62 is provided in the end region of the fixing tenon facing the fastening plate, as shown in FIGS. 8 to 10.

The adjusting element 62 has an upper elongated plate-shaped actuating section 64 which is wider than the width of the elongated through opening 30 in the mounting plate, so that the actuating section 64 laterally overlaps with the through opening 30 in the intended mounting position. A cam 66 with a limited circular orbit that is eccentrically offset relative to the subsequent pin-like lug 60 is provided directly on the underside of the actuating element 64. The height of the cam 66 is essentially identical to the thickness of the material of the fastening sections 28*a* of the mounting plate. When the installation of the hinge is complete, the cam is arranged in a manner depicted in FIG. 1 within the elongated through opening 30 of the mounting plate and supported on the opposing longitudinal sides of the through opening, with the end face of the cam facing the fixing tenon being supported on the top side of the fastening plate 34. The shank of the fastening screw 32 is screwed through a through bore 68 provided in the adjusting element 62, with the longitudinal center axis of the shank coinciding with the longitudinal center axis of the lug-like projection. The diameter of this through bore 68 is slightly greater than the outer diameter of the shank of the fastening screw 32 as measured on the outside threads, thereby preventing the thread of the fastening screw 32 from engaging with the adjusting element 62, i.e., the adjusting element 62 can be rotated in the direction of the arrows d—d of FIG. 3 without also turning the fastening screw.

A recess 70 is provided in the lever-like extended portion of the actuating section for receiving the tip of a screwdriver. To rotate the adjusting element 62, a screwdriver can be inserted into the recess 70 to apply a force along the direction of the arrows d—d. When the adjusting element is rotated, the cam which is supported against the longitudinal edges of the through opening 30 of the mounting plate 28, displaces the mounting plate 28 relative to the fastening plate 34 in the direction of the arrows c—c.

As shown with particularity in FIG. 8, the section of the lug-like projection 60 of the adjusting element 62 that engages with the bearing bore 58 has a peripheral annular projection 72, which interlocks with a complementary annular groove 74 in the bearing bore 58. After the hinge is installed, the fastening plate 34, the mounting plate 28 and the adjusting element 62 are all held in the intended arrangement relative to one another, when the fastening screw 32 is either completely or partially unscrewed from the fixing tenon 44.

It is therefore evident that when the fastening screw is unscrewed, the clamping connection between the end face 18 of the frame element 16 and the underside of the fastening plate 34 is also loosened, allowing an adjustment of the fastening plate in the longitudinal direction of the end face 18 of a corresponding frame element 16—i.e., in the direction of the arrows b—b in FIG. 2. When the fastening screw 32 is unscrewed, the height of a door leaf 12 that is connected to a cupboard body with a hinge according to the invention can be adjusted. To lock a selected height setting, the fastening screw is then again tightened, wherein the free end face of the cam urges the fastening plate 34 against the end face 18, thereby locking the selected position. For adjusting the gap spacing of the door leaf, the adjusting element is rotated in the direction of the arrows d—d of FIG. 2 by exerting a corresponding force in the adjustment direction with a tool inserted into the recess 70. In this case, the fastening screw 32 that fixes the fastening plate 34 on the frame element 16 need not be unscrewed, i.e., the height and/or the gap spacing of the hinge can be adjusted independently, without running the risk of unintentionally also making changes in the other adjustment directions.

What is claimed is:

1. Furniture hinge (for pivotally mounting a door leaf to a cupboard body whose door-side front is narrowed by a frame that projects inwardly at a right angle to the side walls and is formed by frame elements, which frame overlaps at least partially in a closed position with the inside of the door leaf, with a hinge arm made of sheet metal and having on the side facing the cupboard body a mounting plate which can be releaseably secured in superposition with a fastening plate by disposed on the free end face of a frame element of the frame that faces away from the side wall, wherein there is provided in the mounting plate and in the fastening plate at least one elongated through opening extending in the longitudinal direction of the end face of the frame element, through which opening a shank of a fastening screw can be screwed into the frame element, wherein when the fastening screw is unscrewed, the fastening plate is secured for movement in the longitudinal direction of the end face of the frame element, and the mounting plate is secured for movement perpendicular thereto in the transverse direction of the end face on the fastening plate, the fastening screw can be screwed into a fixing tenon, which is fixed in a bore hole disposed in the frame element and from which there protrudes at least one guide projection, which engages in the elongated through opening of the fastening plate and is supported by the side edges of the through opening, an adjusting element which is rotatably supported by a projection in a bearing bore disposed in a front end region of the fixing tenon, wherein the adjusting element comprises an actuating section located above a cam and laterally overlapping the mounting plate proximate to the through opening thereof and having an extension, the peripheral surface of the cam is supported on the longitudinal sides of the through opening of the mounting plate, with the cam having a diameter that is substantially identical to the width of the through opening of the mounting plate and being eccentrically offset relative to the projection, and wherein the head of the fastening screw is screwed in so as to be in clamping engagement with the top side of the actuating section, and wherein the shank of the fastening screw is screwed into the fixing tenon—through a through bore disposed in the adjusting element, wherein the longitudinal center axis of the through bore coincides with the longitudinal center axis of the projection.

2. Furniture hinge, according to claim 1, wherein the fastening plate has on at least one of its longitudinal edges a tab shoulder bent at a right angle, which in the intended mounting position on the end face of a frame element contacts the corresponding front and/or rear flat side of the frame element.

3. Furniture hinge according to claim 1, wherein the mounting plate has shoulders extending from its two edges that extend perpendicular to the longitudinal direction of the end face of the frame element, and being bent in a direction towards the frame element, wherein the shoulders contact the corresponding edges of the fastening plate.

4. Furniture hinge according to claim 1, wherein the fixing tenon is divided at least in its end region inside the bore by a transversely extending slit into two tenon halves which can be spread apart by screwing in the shank of the fastening screw.

5. Furniture hinge according to claim 1, wherein the at least one guide projection is formed so that the fixing tenon is guided in the through opening so as to be displaceable in the longitudinal direction, but formfittingly secured against rotation about its longitudinal center axis.

6. Furniture hinge according to claim 4, wherein when the at least one guide projection is in a defined engagement position with the elongated through opening, the slit extending between the two tenon halves of the fixing tenon is located in a plane extending perpendicular to the longitudinal extent of the through opening and the flat sides of the fastening plate.

7. Furniture hinge according to claim 1, wherein the diameter of the through bore in the adjusting element is at least slightly greater than the maximum diameter of the shank of the fastening screw.

8. Furniture hinge according to claim 1, wherein the width of the elongated through opening provided in the mounting plate is greater than the width of the elongated through opening provided in the fastening plate.

9. Furniture hinge according to claim 1, wherein a measurement of the depth of the bearing bore in the fixing tenon as measured in the direction of the longitudinal center axis is slightly greater than a measurement of the section of the projection, as measured in the direction of longitudinal center axis, that engages in the bearing bore and extends from the flat underside of the cam supported on the top side of the fastening plate.

10. Furniture hinge according to claim 9, wherein the section of the projection that engages in the bearing bore has a circumferential annular projection that interlocks with a complementary annular groove disposed in the wall of the bearing bore.

11. Furniture hinge according to claim 1, wherein the thickness of the cam measured in the direction of the longitudinal center axis of the fixing tenon is substantially identical to the thickness of the mounting plate.

12. Furniture hinge according to claim 1, wherein the hinge arm represents an element that is manufactured separately from the mounting plate, wherein its end facing the mounting plate is releasably secured on a shoulder of the mounting plate which is bent essentially perpendicular into a position that is parallel to the closed inside of the door, so as to be moveable in its released position in a horizontal plane and fixable in selectable displacement positions.

* * * * *